US005429528A

United States Patent [19]

Longueville et al.

[11] Patent Number: 5,429,528

[45] Date of Patent: Jul. 4, 1995

[54] SHIELDING DEVICE FOR CABLE PLUGS

[75] Inventors: Jacques Longueville, Oostkamp; Johan Vanbesien, Izegem, both of Belgium

[73] Assignee: Siemens Aktiengesellschaft, Munich, Germany

[21] Appl. No.: 145,463

[22] Filed: Oct. 29, 1993

[30] Foreign Application Priority Data

Mar. 31, 1993 [DE] Germany ..... 9304928 U

[51] Int. Cl.[6] ..... H01R 13/648

[52] U.S. Cl. ..... 439/608

[58] Field of Search ..... 439/108, 608

[56] References Cited

U.S. PATENT DOCUMENTS 3,587,028 6/1971 Uberbacher ..... 439/608
4,611,867 9/1986 Ichimura et al. ..... 439/608

FOREIGN PATENT DOCUMENTS 405416 1/1991 European Pat. Off. ..... 439/608
9205780 7/1992 Germany .

*Primary Examiner*—Gary F. Paumen

*Attorney, Agent, or Firm*—Herbert L. Lerner; Laurence A. Greenberg

[57] ABSTRACT

A shielded transfer system is disposed on a back panel printed wiring board for receiving cable plugs to be inserted next to one another. A shielding device for the cable plugs includes a rectangular sheet-metal frame having long side walls in the form of two mutually parallel longitudinal plates with ends and upper and lower edges. Individual crosswise plates join the longitudinal plates together at the ends and at certain intervals being predetermined by the cable plugs. The longitudinal plates and the crosswise plates have driving prongs securing the longitudinal plates and the crosswise plates to the printed wiring board. The crosswise plates have upper edges and a height placing the upper edges close to the upper edges of the longitudinal plates. The crosswise plates are hooked to the longitudinal plates at opposing locations as close as possible to the upper edges of the longitudinal plates, and the crosswise plates have lateral protrusions each being inserted into a respective hole formed in one of the longitudinal plates as close as possible to the lower edges of the longitudinal plates, to form an intrinsically stable centering strip for the cable plugs in a state of the shielding device being secured to the printed wiring board.

3 Claims, 2 Drawing Sheets

SHIELDING DEVICE FOR CABLE PLUGS

BACKGROUND OF THE INVENTION

Field of the Invention

The invention relates to a shielding device for cable plugs being insertable next to one another in a shielded transfer system disposed on a back panel printed wiring board, with two longitudinal plates being parallel to one another and secured to the printed wiring board by means of driving prongs.

In shielded transfer systems disposed in the region of a back panel printed wiring board, shielded transfer bridges that include a contact strip are used for a signal transfer in order to receive cable plugs that are insertable next to one another and produce a disconnectable line connection.

German utility Patent DE-GM 92 05 780.2 discloses a contact strip for a shielded transfer system that includes a tub-like strip body of plastic, which is subdivided into individual chambers with prong fields by intermediate crosswise walls and is provided with separate shrouds on its long sides, that are secured to a printed wiring board by means of driving prongs.

SUMMARY OF THE INVENTION

It is accordingly an object of the invention to provide a shielding device for cable plugs, which overcomes the disadvantages of the heretofore-known devices of this general type while giving it the simplest possible structure in terms of its shielding action and assuring adequate mechanical stability that reliably intercepts strains appearing at the cable plugs.

With the foregoing and other objects in view there is provided, in accordance with the invention, in a shielded transfer system disposed on a back panel printed wiring board for receiving cable plugs to be inserted next to one another, a shielding device for the cable plugs, comprising a rectangular sheet-metal frame having long side walls in the form of two mutually parallel longitudinal plates with ends and upper and lower edges; individual crosswise plates joining the longitudinal plates together at the ends and at certain intervals being predetermined by the cable plugs; the longitudinal plates and the crosswise plates having driving prongs securing the longitudinal plates and the crosswise plates to the printed wiring board; the crosswise plates having upper edges and a height placing the upper edges close to the upper edges of the longitudinal plates; and the crosswise plates being interlocked with the longitudinal plates in hook-like fashion at opposing locations as close as possible to the upper edges of the longitudinal plates, and the crosswise plates having lateral protrusions each being inserted into a respective hole formed in one of the longitudinal plates as close as possible to the lower edges of the longitudinal plates, to form an intrinsically stable centering strip for the cable plugs in a state of the shielding device being secured to the printed wiring board.

Such a shielding device includes a centering strip for the cable plug that is formed solely by a sheet-metal frame. Thus the shielding device has a very simple structure, and as a result of the centering strip that surrounds the cable plugs inserted next to one another in frame-like fashion, it assures a complete shielding of the cable plugs on all sides.

In such shielding devices, the cable plugs in the assembled state are generally fixedly locked, so that they can be unlocked only by means of a special tool and then withdrawn. For this reason, major forces affecting the entire mechanical structure of the shielding device can therefore be exerted on the mount of the locked cable plugs as a result of shear strains at the cable outlet. In order to intercept these forces, the cable plugs have previously been screwed on. Other mechanical locking means do not meet the requirements adequately. The centering strip according to the invention thus includes an intrinsically stable sheet-metal structure, which is secured as a whole, with many driving connections, to a back panel printed wiring board. These driving connections assure not only the ground connection but also an adequately strong mechanical anchoring. If the cable plugs are strained very strongly in the transverse direction at the cable outlet, a high tilting moment and a transverse load act upon the centering strip. However, because of the stability attained by means of the driving connections on one hand and the construction with longitudinal and crosswise plates advantageously joined together on the other hand, the centering strip of the shielding device according to the invention is capable of reliably intercepting the forces arising from shear strains at the cable outlet of the cable plugs.

In accordance with another feature of the invention, the crosswise plates have lateral hooks each being bent at an angle toward a respective one of the upper edges of the longitudinal plates, and the longitudinal plates have slits formed therein extending perpendicularly to the printed wiring board for receiving the hooks.

In accordance with a further feature of the invention, the lateral protrusions of the crosswise plates are in the form of cams or toes.

In accordance with a concomitant feature of the invention, the longitudinal plates, as viewed in an upper region in a longitudinal direction, have alternating free cuts with inward-pointing spring arms extending in a plugging direction and webs being angled inward, and the slits for the hooks of the crosswise plates are formed in the webs.

Other features which are considered as characteristic for the invention are set forth in the appended claims.

Although the invention is illustrated and described herein as embodied in a shielding device for cable plugs, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
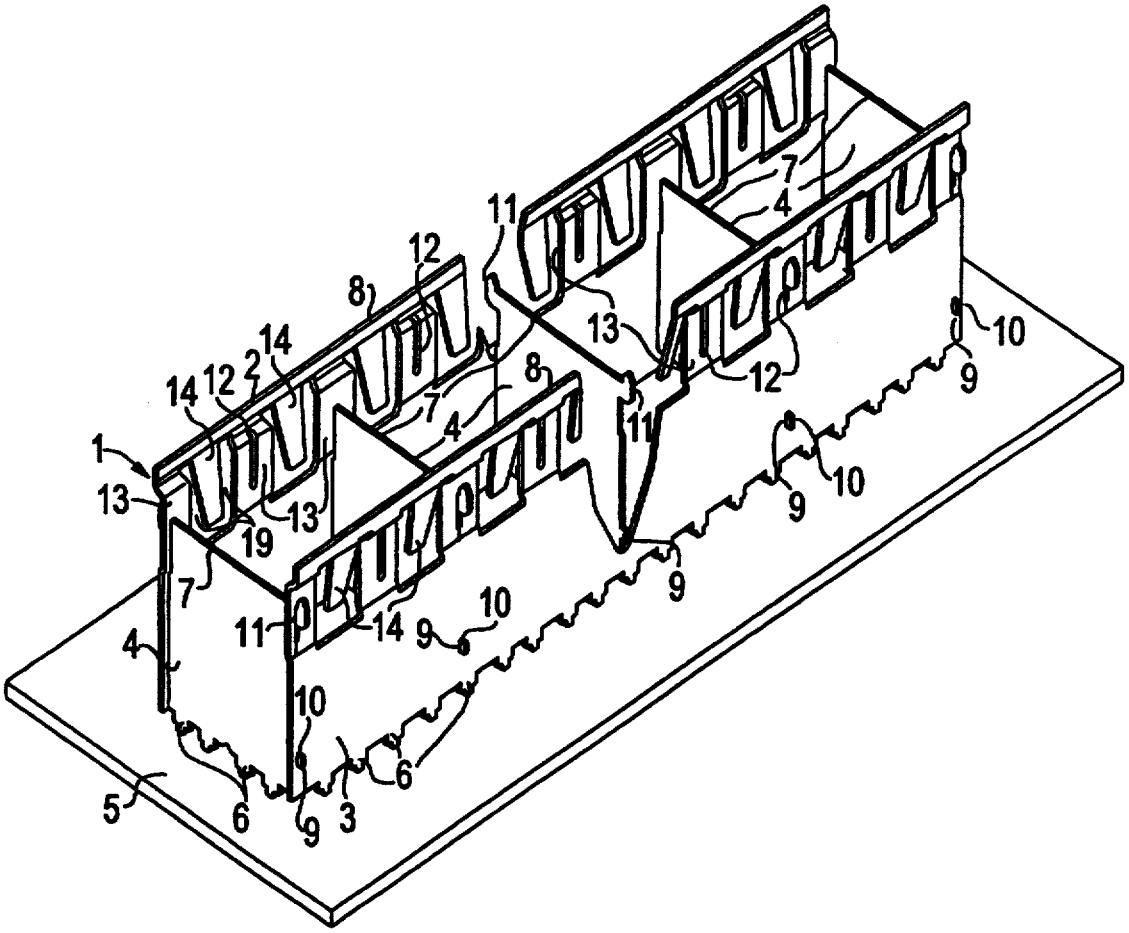
FIG. 1 is a partly broken-away, diagrammatic, perspective view showing the structure of a shielding device secured to a back panel printed wiring board.

Referring now to the figures of the drawing in detail and first, particularly, to FIG. 1 thereof, there is seen a shielding device which includes a rectangular sheet-metal frame 1, that is formed by two longitudinal plates 2 and 3 which are parallel to one another and a plurality of crosswise plates 4 joining the longitudinal plates together transversely. The longitudinal plates 2, 3 and the crosswise plates 4, serving as shielding plates for cable plugs that are insertable next to one another, form rectangular chambers and are each constructed with a number of driving prongs 6 on a lower edge thereof facing toward a printed wiring board 5. Therefore, the sheet-metal frame 1 is inserted as a whole into through-contacted bores in the printed wiring board 5, which communicate with grounding layers of the printed wiring board. In this way a close shielding contact is established between the longitudinal and crosswise plates and these grounding layers.

Figure 3:
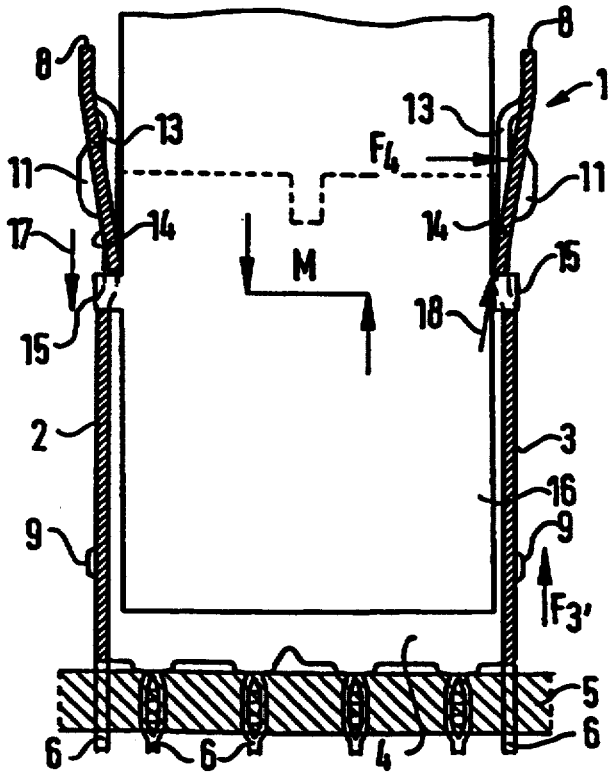

In order to lend the sheet-metal frame itself not only firm anchoring of the shielding device to the printed wiring board, but also high stability, the two longitudinal plates 2 and 3 are joined at ends thereof and are joined in a certain way to the crosswise plates 4 at certain equal intervals, such as 1 SU intervals (SU=system unit, wherein 1 SU=25 mm), which are predetermined by the cable plugs. The cross-wise plates 4 have an upper edge 7 which extends near an upper edge 8 of the longitudinal plates. In other words, in each case at opposed points, the crosswise plates 4 are interlocked in hook-like fashion with the longitudinal plates 2, 3, as close as possible to the upper edge 8 of these plates. The interlocking takes place approximately in the upper quarter of the height of the longitudinal plates, and as close as possible to the lower edge of the longitudinal plates. To that end, approximately in the lower quarter of the height of the longitudinal plates, the crosswise plates 4 have lateral protrusions 9 which are constructed as cams or toes, that are inserted into holes 10 in the applicable longitudinal plate. Moreover, the crosswise plates 4 are constructed with lateral hooks 11 that are bent toward the upper edge 8 of the longitudinal plates 2, 3. These hooks engage slits 12 in the longitudinal plates that extend perpendicularly to the printed wiring board 5. In this case the slits 12 are disposed in webs 13 that are bent at an angle inward and are provided in the upper region of the longitudinal plates, as is seen in the longitudinal direction, by means of free cuts 19 alternating with inward-pointing spring arms 14 extending in the plugging direction. In a chamber, which is formed by two adjacent crosswise plates 4 that are spaced apart by 1 SU, each longitudinal plate thus has one complete web and two half webs 13 in it, which produce a tight, play-free guidance for the insertable cable plug. Then, in the inserted state shown in FIG. 3, the cable plug can be interlocked, for example by two spring arms 14 for each longitudinal plate, because protrusions 15 of a metal housing 16 of the cable plug, which is of rectangular cross section, lock into place behind these spring arms.

The above-described structure of a shielding device, in a state in which it is secured to the printed wiring board 5, results in an intrinsically stable centering strip for a plurality of cable plugs of different sizes that can be inserted next to one another. One such centering strip, in the assembled state, or in other words in the state in which it has been assembled with prong fields and contact prongs, then forms a contact strip, or in the unassembled state, along with a separate contact strip, it forms a transfer bridge for a shielded transfer system disposed on a back panel printed wiring board.

Figure 2:
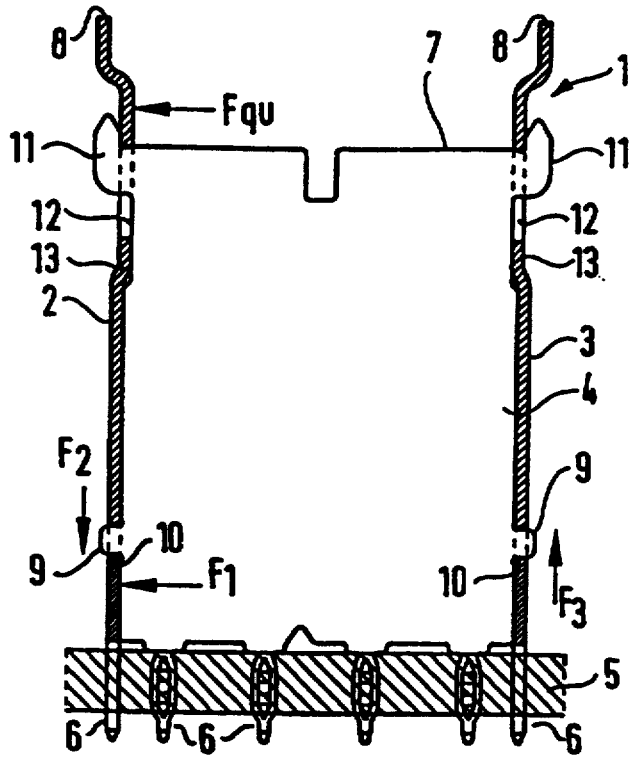
FIGS. 2 and 3 are cross-sectional views each show the structure with a transverse load that occurs in an inserted, loaded cable plug, and a corresponding tilting moment.

In a shielding device of this kind, which is assembled with fixedly locked cable plugs, a transverse load and a tilting moment act upon the centering strip if transverse strains are exerted on the cable outlet of the cable plugs. The effects of the transverse load can be seen in FIG. 2. The transverse load attempts to bring about two possible deformations of the shielding device, namely forcing one lateral plate, for instance the longitudinal plate 2, out of the way laterally, and a deformation of the rectangular shape of the sheet-metal frame into a parallelogram. The crosswise plate 4 prevents the deformation and converts an upper shear force $F_{qu}$ into a shear or displacement force $F_1$ near the printed wiring board 5 and therefore near the fastening of the shielding device to the printed wiring board, and into respective compressive and tensile forces $F_2$ and $F_3$ which act upon the driving connections. Moreover, in the event of shear strains at the cable outlet of the cable plugs, a tilting moment M shown in FIG. 3 acts upon the centering strip, for instance forcing the left-hand lateral longitudinal plate 2 into the printed wiring board 5 in the direction of an arrow 17. If the centering strip is not sufficiently stable, this moment could possibly cause unlocking of the cable plug. On the opposite side, the tilting moment M presses in the direction of an arrow 18 against the obliquely inwardly pointing spring arm 14 that locks the cable plug or its metal housing 16, thereby creating a pulling force $F_3'$ at the driving connections and a shear force $F_4$ seeks to force the longitudinal plate 3 to the side. However, the shear force and its effects are intercepted by the connection which is provided with this centering strip, between the longitudinal and crosswise plates. Forcing the lateral longitudinal plates 2, 3 apart is prevented by the crosswise plates 4 and by the hook-like interlocking between the crosswise and longitudinal plates that is provided as close as possible to the upper edge 8 of the longitudinal plates in the webs 13. This interlocking firmly holds the upper rim of the longitudinal plates. The deformation into a parallelogram is prevented by the two lateral protrusions 9, which are inserted into the matching holes 10 of the longitudinal plates in the lower region of the cross-wise and longitudinal plates. Together with the upper hooks 11, these protrusions 9 form a play-free, undeformable crosswise reinforcement. In this way, all of the tilting moments, as shown and described, are converted into compressive and tensile forces at the driving connections, without deformation of the sheet-metal frame of the centering strip.

We claim:

1. In a shielded transfer system disposed on a back panel printed wiring board for receiving cable plugs to be inserted next to one another, a shielding device for the cable plugs, comprising:

a) a rectangular sheet-metal frame having long side walls defining outer walls of said frame in the form of two mutually parallel longitudinal plates with ends and upper and lower edges;

b) individual crosswise plates joining said longitudinal plates together at said ends and at certain intervals being predetermined by the cable plugs;

c) said longitudinal plates and said crosswise plates having a multiplicity of driving prongs securing said longitudinal plates and said crosswise plates to the printed wiring board;

d) said crosswise plates having upper edges and a height placing said upper edges close to said upper edges of said longitudinal plates;

e) said crosswise plates being hooked to said longitudinal plates at opposing locations as close as possible to said upper edges of said longitudinal plates, and said crosswise plates having lateral protrusions each being inserted into a respective hole formed in one of said longitudinal plates close to said lower edges of said longitudinal plates, to form an intrinsically stable centering strip for the cable plugs when the shielding device is secured to the printed wiring board; and f) said crosswise plates having lateral retaining hooks each being angled toward a respective one of said upper edges of said longitudinal plates, and said longitudinal plates having slits formed therein extending perpendicularly to the printed wiring board for receiving said hooks.

2. The shielding device according to claim 1, wherein said lateral protrusions of said crosswise plates are in the form of cams.

3. The shielding device according to claim 1, wherein said longitudinal plates, as viewed in an upper region in a longitudinal direction, have alternating free cuts with inward-pointing spring arms extending in a plugging direction and webs being angled inward, and said slits for said hooks of said crosswise plates are formed in said webs.

* * * * *